US008550059B2

(12) United States Patent
Makarov et al.

(10) Patent No.: US 8,550,059 B2
(45) Date of Patent: Oct. 8, 2013

(54) METHOD FOR IGNITING A COMBUSTIBLE MIXTURE FOR A COMBUSTION ENGINE

(75) Inventors: Maxime Makarov, Viroflay (FR); Frederic Auzas, Paris (FR)

(73) Assignee: Renault S.A.S., Boulogne Billancourt (FR)

( * ) Notice: Subject to any disclaimer, the term of this patent is extended or adjusted under 35 U.S.C. 154(b) by 62 days.

(21) Appl. No.: 13/257,427

(22) PCT Filed: Mar. 24, 2010

(86) PCT No.: PCT/FR2010/050535

§ 371 (c)(1),
(2), (4) Date: Nov. 8, 2011

(87) PCT Pub. No.: WO2010/109137

PCT Pub. Date: Sep. 30, 2010

(65) Prior Publication Data

US 2012/0048225 A1 Mar. 1, 2012

(30) Foreign Application Priority Data

Mar. 24, 2009 (FR) ..... 09 51854

(51) Int. Cl.
*F02P 3/01* (2006.01)

(52) U.S. Cl.
USPC ..... 123/606; 123/607; 123/608; 123/636; 123/637; 123/638

(58) Field of Classification Search
USPC ..... 123/606–608, 636–638
See application file for complete search history.

(56) References Cited

U.S. PATENT DOCUMENTS

| | | | | |
|---|---|---|---|---|
| 4,122,815 | A * | 10/1978 | Gerry | 123/606 |
| 4,288,723 | A * | 9/1981 | Gerry | 315/209 R |
| 4,677,960 | A * | 7/1987 | Ward | 123/598 |
| 4,846,129 | A * | 7/1989 | Noble | 123/406.14 |
| 5,170,760 | A * | 12/1992 | Yamada et al. | 123/295 |
| 5,456,241 | A * | 10/1995 | Ward | 123/598 |
| 5,842,456 | A * | 12/1998 | Morganti | 123/606 |
| 6,085,733 | A | 7/2000 | Motoyama et al. | |
| 6,694,959 | B1 * | 2/2004 | Miwa et al. | 123/637 |
| 6,814,047 | B2 * | 11/2004 | Vogel et al. | 123/295 |

(Continued)

FOREIGN PATENT DOCUMENTS

| | | |
|---|---|---|
| DE | 10 2004 039259 | 2/2006 |
| DE | 10 2007 044004 | 3/2009 |
| FR | 2 895 169 | 6/2007 |
| FR | 2 913 297 | 9/2008 |

OTHER PUBLICATIONS

International Search Report issued Jul. 14, 2010 in PCT/FR10/050535 filed Mar. 24, 2010.

*Primary Examiner* — Erick Solis
(74) *Attorney, Agent, or Firm* — Oblon, Spivak, McClelland, Maier & Neustadt, L.L.P.

(57) ABSTRACT

A method of igniting a mixture of oxidant and fuel in a combustion chamber of a combustion engine using a spark plug arranged so that it protrudes into the combustion chamber of the engine. The method includes powering the spark plug using a first alternating electrical signal of a frequency higher than 1 MHz, and second powering the spark plug using a second alternating electrical signal of a frequency higher than 1 MHz, the second power taking place after the first powering following a time delay.

11 Claims, 2 Drawing Sheets

(56) References Cited

U.S. PATENT DOCUMENTS

Figure 4A:
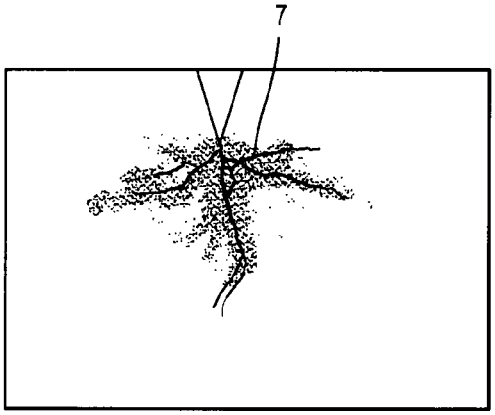

| | | | | |
|---|---|---|---|---|
| 6,895,933 | B2 * | 5/2005 | Miwa et al. | 123/406.47 |
| 6,953,032 | B2 * | 10/2005 | Goede | 123/606 |
| 7,121,270 | B1 * | 10/2006 | Plotnikov | 123/604 |
| 7,647,914 | B2 * | 1/2010 | Kim et al. | 123/299 |
| 7,747,379 | B2 * | 6/2010 | Kita | 701/105 |
| 2002/0144672 | A1 | 10/2002 | Hosoya | |
| 2005/0000500 | A1 * | 1/2005 | Goede | 123/606 |
| 2009/0309499 | A1 | 12/2009 | Agneray et al. | |
| 2011/0139135 | A1 | 6/2011 | Makarov et al. | |
| 2012/0145136 | A1 * | 6/2012 | Burrows et al. | 123/608 |

* cited by examiner

FIG. 1
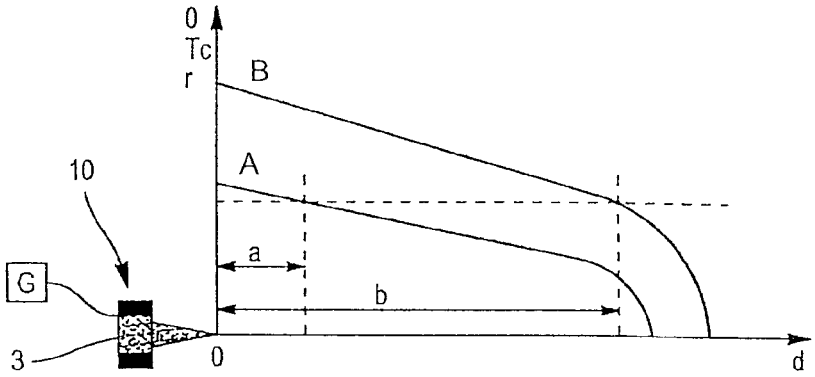
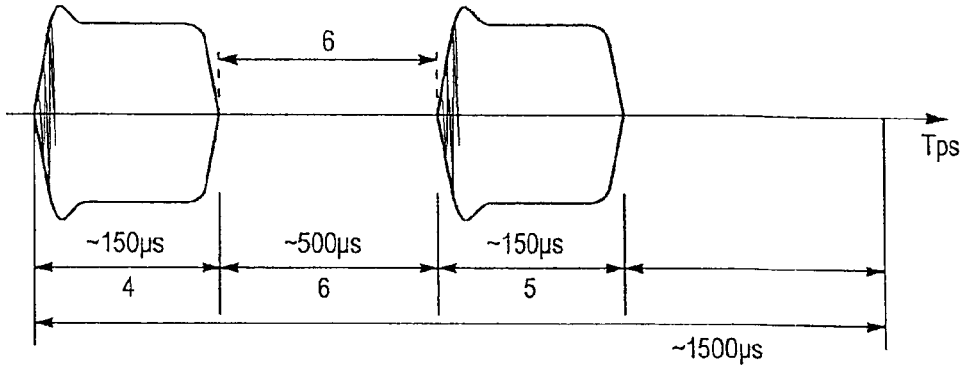
FIG. 2
FIG. 3
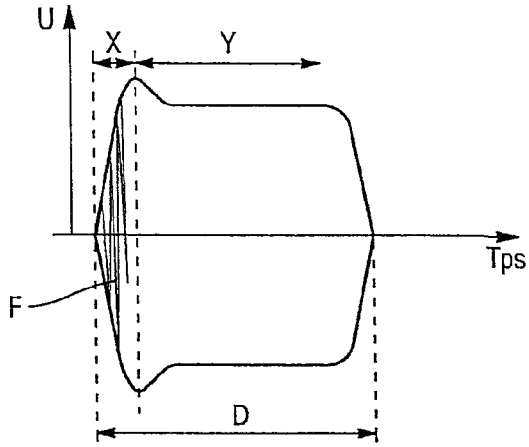

METHOD FOR IGNITING A COMBUSTIBLE MIXTURE FOR A COMBUSTION ENGINE

The present invention relates in general to an ignition method for a combustion engine.

In the field of ignition methods for a combustion engine methods are known that use conventional spark plugs that are found for example in patent documents U.S. Pat. No. 6,085,733 or US 2002/0144672. Such conventional plugs make it possible to generate a linear spark extending between electrodes of the plug.

In order to deal with the problems of ignition defects generated by conventional plugs that can generate only linear sparks, radiofrequency spark plugs have been proposed that are suitable for generating a ramified spark from the tip of an electrode. Unlike the conventional plugs which make it possible to generate only linear sparks, such radiofrequency spark plugs are suitable, in particular through the shape and disposition of their electrodes, for generating a ramified spark when this electrode is supplied with power with the aid of an AC electric signal with a frequency of more than 1 MHz.

A ramified spark produced with the aid of a radiofrequency plug has more chances of igniting a mixture of oxidant and fuel than a linear spark of a conventional plug, since the ramified spark extends in a zone with a volume greater than the zone in which the linear spark produced by a conventional plug extends.

The invention therefore relates more particularly to a method for igniting a mixture of oxidant and fuel in a combustion chamber of a combustion engine with the aid of a radiofrequency spark plug generating a ramified spark from the tip of an electrode, the plug being placed so as to emerge in said combustion chamber of the engine, the method comprising a first step of supplying power to said plug with the aid of a first AC electric signal with a frequency of more than 1 MHz.

Document FR2913297 proposes a method of ignition with the aid of a radiofrequency spark plug in which a resonator is controlled during the ignition by means of a control signal in the form of a plurality of series of pulses, each series having a very short duration, for example from 5 to 10 μs. This control consists in achieving multiple ignitions.

For the comprehension of the invention described below, the term "supplying power to the plug" consists in powering the electrode of the plug furnished with a tip with the aid of an AC electric signal with a frequency of more than 1 MHz; in this instance it involves supplying power to the pointed electrode by AC signals hereinafter called the first and second AC electric signals.

The type of ignition method carried out by supplying power to at least one plug with the aid of an AC electric signal with a frequency of more than 1 MHz is known as the radiofrequency ignition method.

One object sought by the present invention is to improve the volume of ignited mixture and also to reduce the failed ignitions of mixture despite the electrical powering of the plug.

For this purpose, the ignition method of the invention, moreover conforming to the generic definition given thereto by the preamble defined above, is essentially characterized in that it comprises a second step of supplying power to said plug with the aid of a second AC electric signal with a frequency of more than 1 MHz, this second step being subsequent to the first step and spaced in time relative to the first step at a spacing delay.

The spark produced by the plug when it is supplied with power with an electric signal with a frequency of more than 1 MHz has a shape that ramifies in the mixture and usually comprises several branches. The spark comprises several portions the diameter of which decreases as it moves away from the origin of the spark (that is to say in the location where the spark is triggered) to its ends (the location where the spark ceases to extend). It has been noted that the temperature of the spark varies along the spark and decreases with the diameter of the spark portions.

The flame in the mixture is initiated in the hottest locations of the mixture, that is to say in the spark portions that have the largest diameters. It has also been found that, when two sparks are triggered consecutively and prior to the ignition of the mixture, the second spark occurs substantially in the same location as the first spark while having fewer ramifications. Thus, the mixture is preheated in the vicinity of the sparks produced by virtue of the first step, then, by virtue of the second step, producing less ramified sparks, the rise in temperature continues beyond the temperature obtained by virtue of the first step and this happens until combustion is initiated. The volume of the mixture where the combustion caused by the second step is initiated is therefore greater than the volume of mixture that would be ignited via the first step alone.

Thus the ignition of the mixture that is present in the combustion chamber is initiated by at least two distinct signals of respective frequencies of more than 1 MHz which generate respectively at least two radiofrequency sparks.

By virtue of the invention, the volume of ignited mixture is greater than it would be if the ignition was initiated by only one electric signal. The invention therefore makes it possible to reduce the number of misfires and the volume of unburnt fuel while increasing the speed of flame propagation in the chamber.

It is also possible to see to it that said spacing delay between the first and second steps is less than 10 times the duration of the first step and preferably less than 5 times the duration of the first step.

This feature limits the delay between the two signals supplying power to the plug so as to minimize the risk of cooling of the mixture that has been preheated by the first spark, which is a condition improving the size of the volume of ignited mixture.

It is also possible to see to it that the spacing delay between the first and second steps is greater than the duration of the first step.

It has been noted that this minimum-delay condition between the two steps/sparks makes it possible to reduce the number of ramifications of the second spark relative to the first spark, thus permitting a lengthening of the ramifications and an increase in the average diameter of the ramifications of the second spark relative to the first spark. This average diameter is calculated over the length of a given spark branch.

It is also possible to see to it that the spacing delay between the first and second steps is between 1 and 5 times the duration of the first step.

With such a spacing delay of the first and second steps, it has been noted that a maximum volume of ignited mixture is obtained and that this is true for various oxidant/fuel mixtures that are more or less rich.

It is also possible to see to it that said first and second signals have respective frequencies that are preferably more than 1 MHz.

With such frequency levels, it is easier to maintain a spark over the whole duration of the supplying of power to the plug thus allowing an optimum heating of the mixture by the first power-supply step then an ignition of a considerable volume of mixture by virtue of the second step of supplying power to the plug. Then, the flame front is propagated from the filaments of the spark generated by the second step of supplying power to the plug in the direction of the walls of the combustion chamber into which the plug emerges.

It is also possible to see to it that each of said first and second electric signals has specific parameters which are the voltage amplitude U of the signal, the frequency F of the AC electric signal, the total duration D of the signal and that at least one of the parameters of at least one of said first and second signals is determined during a step prior to said first and second steps depending on parameters determining the combustion, these parameters determining the combustion being measured and/or estimated and comprising at least one pressure P in the combustion chamber, one temperature T representative of the temperature inside the chamber, the richness of the mixture of fuel and oxidant and a ratio of burnt gases present in the mixture.

Determining at least one of the parameters of at least one of the first and second signals depending on the operating features of the combustion engine (pressure, temperature, fuel richness) makes it possible to adapt the nature of the spark produced during the first and/or the second step depending on the conditions pertaining in the chamber which makes it possible to optimize the ignition conditions.

It is also possible to see to it that the duration of the first step is between 150 and 250 μs, that the duration of the second step is between 150 and 250 μs and that said spacing delay between the first and second steps is between 250 and 750 μs.

The combination of signals for supplying power to the plug with frequencies of more than 1 MHz with durations of the first and second power-supply steps of between 150 and 250 μs and a spacing delay between these steps of between 250 and 750 μs makes it possible to increase in a surprising manner the average length of the ramified sparks generated during the second power-supply step, thus significantly reducing the number of firing defects.

For the comprehension of the invention, the first signal is emitted throughout the whole of the first step and only during this first step. Similarly, the second signal is emitted throughout the whole of the second step and only during this second step.

With these durations of the first and second steps and of the spacing delay between the first and second steps, it has been found that the time for forming the core of the flame front in the combustion chamber is approximately 2000 μs, which is particularly rapid and this occurs while increasing the ratio of successful firings.

The invention also relates to a system for igniting a mixture of oxidant and fuel for a combustion engine comprising a current generator and at least one spark plug connected to said generator, said generator being suitable for generating a first AC electric signal with a frequency of more than 1 MHz and a second AC electric signal with a frequency of more than 1 MHz. The system of the invention is characterized in that said generator is suitable for spacing in time said first and second AC electric signals at a spacing delay and is suitable for applying the method according to the invention.

The first and second signals generated by the current generator are such that they allow the generation, via the plug thus supplied with power, of sparks spaced from one another by a predetermined spacing time delay. Thus the system of the invention has the same advantages as those described with respect to the method of the invention.

The invention also relates to a combustion engine comprising a combustion chamber and the aforementioned ignition system.

Figure 4B:
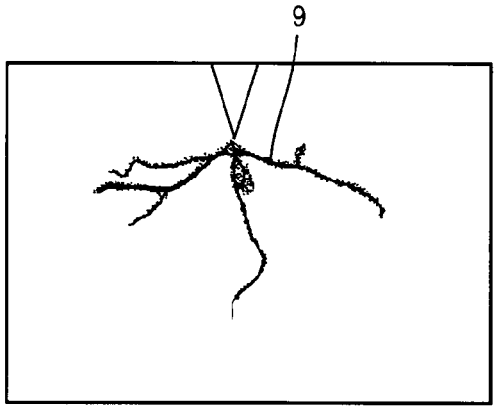

Other features and advantages of the invention will emerge clearly from the description made thereof below, as an indication and in no way limiting, with reference to the appended drawings in which:

FIG. 1 represents a view of a tip of a plug of the system according to the invention and allowing the application of the method according to the invention, and respective zones "a" and "b" being the zones of ignition without the method of the invention (zone "a") and with the method of the invention (zone "b"), the zone "b" being greater than the zone "a";

FIG. 2 shows a timing chart of supplying power to the plug with, on the x axis, the time and, on the y axis, the intensity of the signal supplying power to the plug, said first and second electric signals for supplying power to the plug and the spacing delay between these signals are represented in this FIG. 2, which therefore describes the phasing of the signals necessary for applying the method of the invention;

FIG. 3 shows the detail of one of the signals represented in FIG. 2, this signal being able to be the first or the second signal because these signals are, in this particular embodiment, identical;

FIG. 4*a* shows a spark emitted when the plug receives a first power-supply signal with a high frequency of more than 1 MHz, in this instance this first signal is of 5 MHz;

FIG. 4*b* shows a spark emitted when the plug receives a second power-supply signal with a high frequency of more than 1 MHz, in this instance this second signal is of 5 MHz; this spark of FIG. 4*b* is less ramified than that of FIG. 4*a* and has an amplitude and a width of spark branch that are greater than they are in FIG. 4*a;*

Figure 5A:
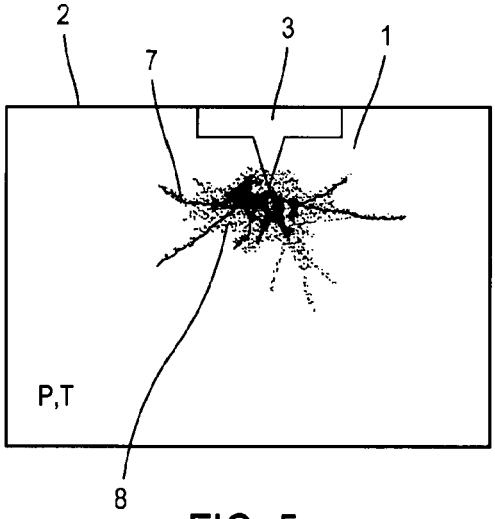
Figure 5B:
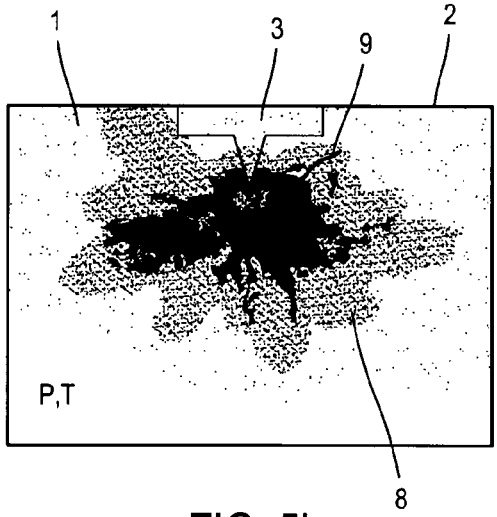

FIG. 5*a* shows the flame zone initiated by a single radiofrequency RF spark as is the case in the prior art (FIG. 4*a*);

FIG. 5*b* shows the zone of flame initiated with the method according to the invention which generates two consecutive radiofrequency RF sparks (FIG. 4*b*) that are spaced from one another in time; it is noted that this zone of flame of FIG. 5*b* is much more extensive than that of FIG. 5*a*.

As announced above, the invention relates to a method for igniting a mixture of oxidant and fuel in a combustion chamber with the aid of a plug and the ignition system 10 allowing the method according to the invention to be applied and an engine including this system.

FIG. 1 shows a spark plug 3 connected to the generator G which is suitable for delivering first and second AC electric signals 4, 5 with frequencies that are more than or equal to 1 MHz for a duration of at least 150 μs, these signals being spaced from one another by a delay 6 of between 200 and 600 μs. This phasing of the signals is represented on the curve 2 which shows the first signal 4 for supplying power to the plug 3 emitted during a first step 4 followed by a delay with no signal 6, itself immediately followed by a second signal 5 emitted during the second step 5.

As can be seen in FIG. 1:

the curve A shows the spark temperature when the plug 3 is powered with only a first signal 4; and the curve B shows the spark temperature when the plug 3 is powered via the second signal 5 after the first signal 6 and within a given spacing delay of signals 6. The spacing delay of signals must be adjusted when developing the system according to operating characteristics of the combustion engine in order to adapt the nature of the spark produced to the conditions pertaining in the chamber which makes it possible to optimize the ignition conditions.

The spacing duration 6 between the first and second signals is chosen to be greater than at least one times the duration of the first signal (that is to say the duration of the first step 4), in this instance, this spacing duration 6 is 1500 μs or 3.3 times longer than the duration of the first signal 4 (that is to say 150 μs).

The horizontal dashed line in FIG. 1 represents a minimum temperature threshold necessary for ignition. For the mixture to ignite, it is therefore necessary that this mixture is heated by the spark to a temperature above the ignition temperature threshold.

Thus, in the case in which the plug is supplied via the first signal, the possible ignition zone has a maximum length "a" that is much shorter than the length "b" defining the possible ignition zone when the plug is powered with the second signal after the first.

Thus, the ignition zone during the second signal is much greater than the ignition zone during the first signal, which makes it possible to increase the speed of propagation of flame in the chamber and reduce the unburnt elements and misfires.

This increase in the potential ignition zone results:

from the fact that the spark 9 of the second step 5 (visible in FIG. 4*b* triggered 500 μs after that of FIG. 4*a* generated during the first step) is longer and less ramified than the spark 7 of the first step 4; and from the fact that the spark 9 of the second step 5 (FIG. 4*b*) has an average branch diameter greater than the average branch diameter of the spark 7 of the first step 4 (FIG. 4*a*); and from the fact that the temperature T in the spark zone of the second step 5 is higher than the temperature T in the spark zone of the first step 4.

Consequently, and as confirmed by FIGS. 5*a* and 5*b*, the mixture-ignition zone 8 ("8" representing the volume of ignited mixture) in the combustion chamber 2 is more extensive when using the method according to the invention, with two successive high-frequency plug power-supply signals that are spaced from one another by a given minimum delay (FIG. 5*b*) than the ignition zone resulting from a single signal (FIG. 5*a*).

Finally, as shown in FIG. 3, a given signal (first or second signal emitted during the first or second step 4, 5) has a plug-tip AC voltage U (with a frequency F) the amplitude of which increases as it moves away from the beginning of the plug power-supply step until it reaches a maximum voltage. This first portion X of voltage U amplitude increase corresponds to the portion of formation of spark filaments. Then, after reaching this maximum, the voltage U reduces until it stabilizes at a given threshold; this second portion Y of the signal corresponds to the period of temperature increase of the filaments of the spark. The signal is emitted for a duration D which corresponds to the duration of the plug power-supply step 3.

In order to improve the method according to the invention, these signal parameters U, F and D of each of the first and/or second signals may be predetermined according to the operating parameters of the engine which are the pressure P and/or the temperature T in the chamber 2 and/or the richness of the ignited mixture 8.

The invention claimed is:

1. A method for igniting a mixture of oxidant and fuel in a combustion chamber of a combustion engine with aid of a radiofrequency spark plug generating a ramified spark from a tip of an electrode, the plug being placed to emerge in the combustion chamber of the engine, the method comprising:

a first supplying power to the plug with aid of a first AC electric signal with a frequency of more than 1 MHz to create a first ignition zone during a combustion cycle; and a second supplying power to the plug with aid of a second AC electric signal with a frequency of more than 1 MHz to create a second ignition zone during the combustion cycle, the second powering being subsequent to the first powering and spaced in time relative to the first powering at a spacing delay, and the spacing delay is greater than a duration of the first powering.

2. The method as claimed in claim 1, wherein the spacing delay between the first and second powerings is less than 10 times a duration of the first powering.

3. The method as claimed in claim 2, wherein the spacing delay between the first and second powerings is less than 5 times a duration of the first powering.

4. The method as claimed in claim 1, wherein each of the first and second electric signals has specific parameters that are voltage amplitude of the signal, frequency of the AC electric signal, total duration of the signal, and wherein at least one of the parameters of at least one of the first and second signals is determined during an operation prior to the first and second powerings depending on parameters determining the combustion, the parameters determining the combustion being measured and/or estimated and comprising at least one pressure in the combustion chamber, one temperature representative of the temperature inside the chamber, richness of a mixture of oxidant and fuel, and a ratio of burnt gases present in the mixture.

5. The method as claimed in claim 1, wherein a duration of the first powering is between 150 and 250 μs and a duration of the second powering is between 150 and 250 μs, and wherein the spacing delay between the first and second powerings is between 250 and 750 μs.

6. A system for igniting a mixture of oxidant and fuel for a combustion engine comprising:

a current generator and at least one spark plug connected to the generator, the generator configured to generate a first AC electric signal with a frequency of more than 1 MHz and a second AC electric signal with a frequency of more than 1 MHz, wherein the generator is configured to space in time the first and second AC electric signals at a spacing delay and to:

supply a first power to the plug with aid of the first AC electric signal with a frequency of more than 1 MHz to create a first ignition zone during a combustion cycle; and supply a second power to the plug with aid of the second AC electric signal with a frequency of more than 1 MHz to create a second ignition zone during the combustion cycle, the second power being supplied by the generator subsequent to the first power and spaced in time relative to the first power at a spacing delay, and the spacing delay is greater than a duration of the first powering.

7. The method as claimed in claim 1, wherein the spacing delay between the first and second powerings is less than 5 times the duration of the first powering.

8. The system for igniting a mixture of oxidant and fuel for a combustion engine comprising:

a combustion chamber, a current generator and at least one spark plug connected to the generator, the generator configured to generate a first AC electric signal with a frequency of more than 1 MHz and a second AC electric signal with a frequency of more than 1 MHz, wherein the generator is configured to space in time the first and second AC electric signals at a spacing delay and to:

supply a first power to the plug with aid of the first AC electric signal with a frequency of more than 1 MHz to create a first ignition zone during a combustion cycle; and supply a second power to the plug with aid of the second AC electric signal with a frequency of more than 1 MHz to create a second ignition zone during the combustion cycle, the second power being supplied by the generator subsequent to the first power and spaced in time relative to the first power at a spacing delay, and the spacing delay is greater than a duration of the first powering.

9. The method as claimed in claim 1, wherein an area of the second ignition zone is greater than an area of the first ignition zone.

10. The system as claimed in claim 6, wherein an area of the second ignition zone is greater than an area of the first ignition zone.

11. The system as claimed in claim 8, wherein an area of the second ignition zone is greater than an area of the first ignition zone.

* * * * *